United States Patent [19]

Roth et al.

[11] 4,292,259

[45] Sep. 29, 1981

[54] ARRANGEMENT FOR SUCKING-OFF GASES

[75] Inventors: Zdenek Roth, Pilsen; Josef Altmann, Domazlice, both of Czechoslovakia

[73] Assignee: SKODA, oborovy podnik, Pilsen, Czechoslovakia

[21] Appl. No.: 115,569

[22] Filed: Jan. 28, 1980

[30] Foreign Application Priority Data

Feb. 12, 1979 [CS] Czechoslovakia ..... 915-79

[51] Int. Cl.[3] ..... B01F 3/04

[52] U.S. Cl. ..... 261/123; 122/487; 261/76; 261/DIG. 75

[58] Field of Search ..... 122/487; 261/76, 77, 261/22, 121 R, 123, DIG. 10, DIG. 75, DIG. 76

[56] References Cited

U.S. PATENT DOCUMENTS

| | | | |
|---|---|---|---|
| 832,737 | 10/1906 | Kaeferle | 261/77 X |
| 2,328,414 | 8/1943 | Beyer | 261/77 X |
| 3,774,846 | 11/1973 | Schurig et al. | 261/DIG. 75 |
| 3,938,738 | 2/1976 | Nagel et al. | 261/DIG. 75 |
| 4,019,983 | 4/1977 | Mandt | 261/DIG. 75 |
| 4,098,851 | 7/1978 | Schulte et al. | 261/77 X |

FOREIGN PATENT DOCUMENTS

| | | | |
|---|---|---|---|
| 545187 | 6/1956 | Italy | 261/77 |
| 91973 | 12/1921 | Switzerland | 261/77 |

*Primary Examiner*—Richard L. Chiesa

[57] ABSTRACT

Arrangement for sucking-off gases, creating by means of water supplied to an annular nozzle surrounding the outlet of a gas conduit and forming a first hydraulic pump with a vortex, thereby mixing the gas and water thoroughly and sucking off the mixture by a second annular water nozzle into an ejector or second pump extending into a diffuser which terminates below the level of water in a vessel, where separation of the gas and water takes place.

3 Claims, 1 Drawing Figure

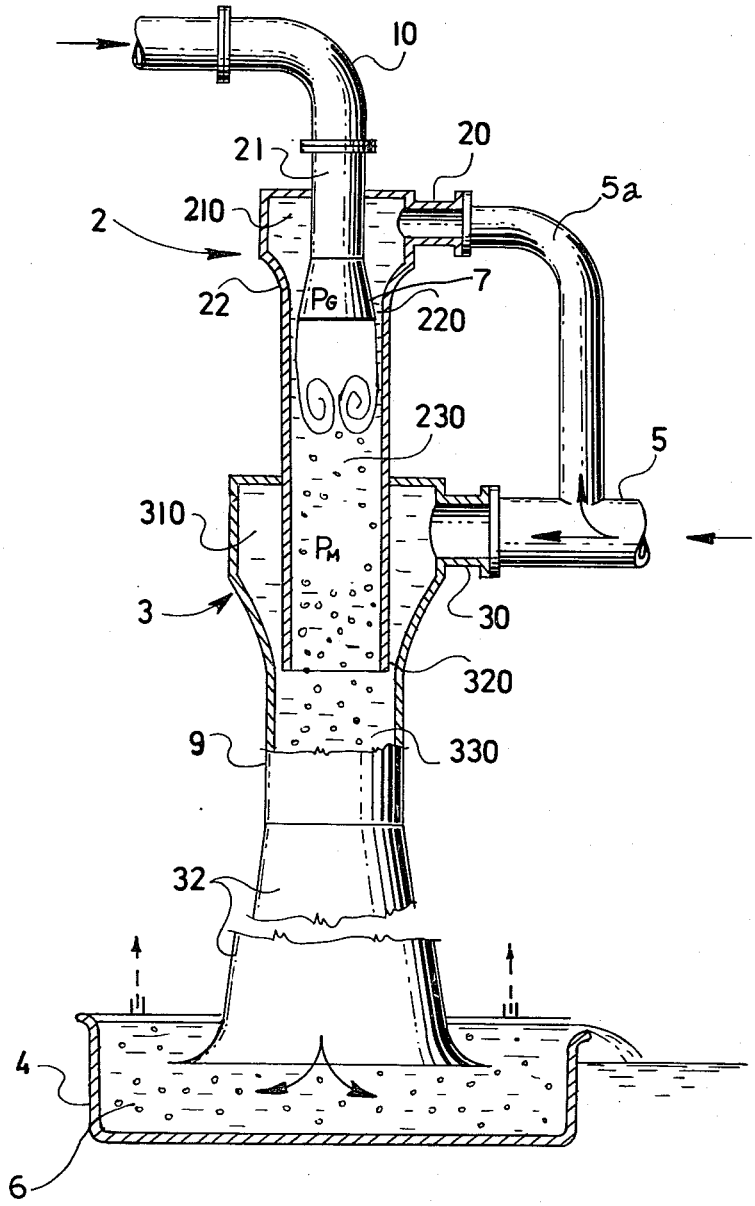
10
21
20
5a
210
2
22
PG
7
220
230
5
310
PM
3
30
320
9
330
32
4
6

ARRANGEMENT FOR SUCKING-OFF GASES

BACKGROUND OF THE INVENTION

The invention relates to an arrangement for sucking-off gases; such arrangement is particularly suitable for sucking-off air from a steam turbine condenser.

A number of solutions for sucking-off gases are known. These can be generally divided into arrangements operating convectionally and arrangements operating by volume quantities. Convectional arrangements usually are provided with one or several jets of a working liquid, which liquid is conveniently mixed with the gas and, due to the momentum of the working liquid of the transmitted mixture, this mixture is brought to a higher pressure level, which level with arrangements operating like exhaustors is usually atmospheric pressure.

Another example of a convectional arrangement for conveying gases is a channel with an annular hydraulic pump used with arrangements wherein for the mixing a large interphase surface between the gas and water is required, as for instance in the aeration of water in the outlets of water dams.

In recently proposed arrangements operating by volume quantities for sucking-off gases, a solution with a rotating sealing water annulus and an eccentrically rotating system of working chambers is known.

All of the above-mentioned arrangements have some drawbacks. Convectionally operating arrangements have a low efficiency; such efficiency can be defined as the ratio between the product of the gas mass passage and of the difference of pressure potentials in spaces between which the gas is conveyed and the product of the mass passage and the required pressure potential of the working liquid. Drawbacks of arrangements operating by volume quantities are the relatively difficult access to them and their high investment costs.

SUMMARY OF THE INVENTION

It is an object of this invention to provide an arrangement which to a high degree eliminates these drawbacks, which is relatively simple, and has a substantially higher efficiency.

The exemplary arrangement for sucking-off gases according to this invention comprises an air nozzle, a tubular body and an ejector. The air nozzle engages into the tubular body and forms within the space of the tubular body a water chamber connected to a water supply conduit, an annular nozzle and a chamber, such parts constituting a first hydraulic ejector or hydraulic jet pump. This tubular body engages in turn into an ejector or second hydraulic jet pump where it forms a chamber connected to a water supply conduit, an annular nozzle and a mixing chamber, whereby this ejector, or second hydraulic pump, extending into a diffuser the lower extremity of which extends below the upper level of a body of water contained in an open topped vessel. The thus removed gas then escapes from such body of water.

An advantage of the arrangement according to this invention is its simplicity and its high efficiency.

DESCRIPTION OF DRAWING

An exemplary embodiment of an arrangement for sucking-off gases according to this invention is shown in the attached drawing which is a view in elevation with certain of its parts in longitudinal section, such arrangement being adapted to be connected to a condenser of a steam turbine.

DESCRIPTION OF PREFERRED EMBODIMENT

This exemplary arrangement for sucking-off gases comprises a first jet hydraulic pump 2 or mixing part adapted to be connected by a connecting conduit 10 to a condenser (not shown) of a steam turbine and a second jet hydraulic pump 3 or ejector, ejector 3 having a diffuser 32 the lower end of which terminates in an open topped vessel 4. The first hydraulic pump 2 comprises an air nozzle 21, connected to the connecting conduit 10 and engaging by its lower widened extremity 7 into a chamber 230 of the first hydraulic pump, formed within the lower internal part of the tubular body 22. The ejector or second hydraulic pump 3 has a tubular body 9 concentric with tubular body 22. Body 9 is so arranged that it forms in its upper part a chamber 310, in the central part a mixing chamber 320, and in the lower part a widened part or diffuser 32. The connection between the first hydraulic pump 2 and the second hydraulic pump 3 is arranged so that the lower part of the tubular body 22 engages into the chamber 310 of the second pump 3.

A water chamber 210 is provided within the upper part of the tubular body 22, which is provided with a neck 20 connected to a water supply conduit 5*a*. The chamber 310, provided in the upper part of the second pump 3, is provided with a supply neck 30 connected with a lower branch of the water supply conduit 5. The air nozzle 21 is situated concentrically in the water chamber 210 so that an annular gap 220, forming an annular nozzle is provided between the external surface of this air nozzle 21 and the internal surface of the water chamber 210. Both the annular nozzle 220 and the air nozzle 210 terminate in the upper part of the chamber 230 of the second hydraulic pump. This chamber 230 of the second hydraulic pump terminates concentrically into the mixing chamber 330 so that between the external surfaces of the chamber 230 of the second hydraulic pump and the internal surface of chamber 310 there is an annular gap 320 which forms an annular nozzle 320.

Both the annular nozzle 320 and the chamber 230 of the second hydraulic pump terminate into the upper part of the mixing chamber 330 of the second hydraulic pump 3. The lower widened end of the diffuser 32 terminates below the upper surface of the water 6 in the vessel 4.

The operation of the arrangement according to this invention is based on the utilization of the vortex of a first hydraulic pump 2 for homogenizing the mixture of water and air in the mixing part of first pump 2, and for efficiently raising the pressure of the thus formed mixture by the ejector or second pump 3 to atmospheric pressure. The air sucked off from the condenser of a steam turbine via the connecting conduit 10 passes via the air nozzle 21 into the first pump or mixing part 2 at a level where the annular nozzle 21 terminates. Water supplied via the supply conduit 5 passes through the annular gap or nozzle 220 at high speed. By the maintenance of conditions for the creation of a hydraulic pump determined by the pressure condition in the water chamber 210 and in the chamber 230 of the hydraulic pump, i.e. in front of and behind the hydraulic pump by the interaction of the annular water jet determined by the relative dimensions of the annular nozzle 220 and the wall of the chamber 230 of the hydraulic pump, and the amount of air supplied to the hydraulic pump by the air nozzle 21 there is created a highly turbulent vortex characterizing the hydraulic pump 2, which sucks-on and perfectly mixes the incoming air having a pressure $P_o$ with water passing through the annular nozzle 220 and compresses the formed mixture to a separating or discharging pressure $P_M$.

The process which takes place in the chamber 230 of the hydraulic pump 3 has a highly dissipative character and is connected with a substantial loss of the mechanical energy of water passing from the annular nozzle 220. The effect of the hydraulic pump 2 in the arrangement for sucking-off gases according to this invention is therefore limited to the creation of a homogenous mixture of water and air and to the achievement of a suitable separating pressure $P_M$ so as to secure an optimum efficiency of the second pump or ejector 3. The overall efficiency of the arrangement is thus higher than with classical ejectors, thereby reducing substantially the consumption of the necessary working water. The mixture of water and air supplied to the second pump or ejector 3 from the chamber 230 of the second hydraulic pump in the mixing chamber 330 of the second pump 3 is accelerated by the momentum of the water passing through the annular nozzle 320 of pump 3, into which nozzle 320 water is supplied from chamber 310 connected to the water supply conduit 5.

A further additional homogenization of the original mixture of air with water passing through the annular nozzle 320 of the second pump 3 is achieved. The formed mixture with increased kinetic energy and increased specific mass in the lower part of the mixing chamber 320 is brought to the diffuser 32. Due to the geometric arrangement of this diffuser 32 the kinetic energy is gradually transformed to static pressure, which together with the relative hydrostatic height secures the discharge of the mixture of air and water via the lower part of the diffuser 32 below the water level in the vessel 4. A sepatation of air from the mixture of water and air supplied via the diffuser 32 takes place in the content of water of the vessel 4, and air escapes above the water level of the vessel 4 into the atmosphere.

The invention can be utilized not only with condensers of steam turbines, but in any case wherein uncondensable gases have to be conveyed while they are simultaneously compressed.

Although the invention as illustrated and described with reference to one preferred embodiment thereof, it is to be expressly understood that it is in no way limited to the disclosure of such preferred embodiment but is capable of numerous modifications within the scope of the appended claims.

We claim:

1. Arrangement for sucking-off air from an air-containing flowing fluid, comprising a first jet hydraulic pump having a first tubular body with an upper part constituting a first liquid chamber, conduit means supplying the first liquid chamber with liquid under pressure, a first air-containing fluid receiving and discharging conduit having a widened lower end disposed within the first liquid chamber with the outer edge of the widened lower end thereof spaced from the inner wall of the first liquid chamber to form a narrow annular gap therebetween acting as a nozzle to form a thorough, turbulent mixture of liquid and air-containing fluid, a second jet hydraulic pump disposed below the first jet hydraulic pump, the second jet hydraulic pump having a second tubular body with an upper part constituting a second liquid chamber, the lower end of the first tubular body extending into the second liquid chamber, the outer edge of the lower end of the first tubular body being spaced from the inner wall of the second liquid chamber to form a narrow annular gap therebetween, the second tubular body continuing downwardly below the end of the first tubular body and terminating at its lower end in a widened portion constituting a diffuser, conduit means for supplying the second liquid chamber with liquid under pressure, and an open-topped vessel within which the lower, diffuser-forming portion of the second tubular body is received, the vessel containing the mixture of air-containing fluid and the liquid forwarded thereto through the second tubular body to a level above the lower, diffuser-forming end of the second tubular body, air escaping from such mixture in the vessel to the atmosphere.

2. An arrangement according to claim 1, wherein the liquid supplied to the first and second liquid chambers through their respective conduit means is water.

3. Arrangement for sucking-off gases from containers, comprising a first jet hydraulic pump having a first tubular body with an upper part constituting a first liquid chamber, first conduit means supplying the first liquid chamber with liquid under pressure, a first, gas-conducting conduit having a widened lower end disposed within the first liquid chamber with the outer edge of the widened lower end thereof spaced from the inner wall of the first liquid chamber to form a narrow gap therebetween acting as a first nozzle to form together with turbulent processes in the first mixing chamber's thorough mixing of liquid and gas, the widened lower end of the gas-conducting conduit constituting a diffuser, a further conduit disposed beneath the first mixing chamber and communicating with the lower end thereof, a vessel in which the lower end of the further conduit is received, the vessel containing the mixture of air-containing fluid and the liquid forwarded thereto through the further conduit to a level above the lower end of the further conduit, air escaping from such mixture in the vessel to the atmosphere, the further conduit defining the mixing chamber of a second hydraulic pump disposed between the first mixing chamber of the first jet hydraulic pump, the upper part of said further tubular body constituting a second liquid chamber, the lower end of the first tubular body extending into the second liquid chamber, the outer edge of the lower end of the first tubular body being spaced from the inner wall of the second liquid chamber to form a narrow annular gap therebetween, and conduit means for supplying the second liquid chamber with liquid under pressure.

* * * * *